United States Patent [19]

Herrington

[11] Patent Number: 4,795,412

[45] Date of Patent: Jan. 3, 1989

[54] APPARATUS FOR FORMING A HEM IN A MOVING WEB OF FILM

[75] Inventor: Fox J. Herrington, Holcomb, N.Y.

[73] Assignee: Mobil Oil Corporation, New York, N.Y.

[21] Appl. No.: 132,693

[22] Filed: Dec. 14, 1987

Related U.S. Application Data

[63] Continuation of Ser. No. 938,893, Dec. 8, 1986, abandoned.

[51] Int. Cl.[4] ..... B31B 1/90

[52] U.S. Cl. ..... 493/225; 493/193; 493/928; 493/248

[58] Field of Search ..... 493/193–196, 493/201, 225, 248, 251, 438–440, 446, 447, 455, 456, 459, 928, 406

[56] References Cited

U.S. PATENT DOCUMENTS

| | | | |
|---|---|---|---|
| 2,348,196 | 5/1944 | Duhaime | 493/248 |
| 2,897,729 | 8/1959 | Ashton et al. . | |
| 3,029,853 | 4/1962 | Piazze . | |
| 3,058,402 | 10/1962 | Kugler . | |
| 3,058,403 | 10/1962 | Kugler . | |
| 3,396,638 | 9/1968 | Lepisto | 493/196 |
| 3,406,610 | 10/1968 | Golden . | |
| 3,414,032 | 12/1968 | Jortikka . | |
| 3,656,415 | 4/1972 | Hook, Jr. | 493/196 |
| 3,759,772 | 9/1973 | Andersson . | |
| 3,812,269 | 5/1974 | Barnes et al. | 493/196 |
| 4,055,109 | 10/1977 | Kan | 493/196 |
| 4,202,721 | 5/1980 | Roberts . | |
| 4,717,373 | 1/1988 | Catchman et al. | 493/225 |

FOREIGN PATENT DOCUMENTS

| | | |
|---|---|---|
| 1125363 | 8/1968 | United Kingdom . |

*Primary Examiner*—Robert P. Olszewski
*Assistant Examiner*—Robert Showalter
*Attorney, Agent, or Firm*—Alexander J. McKillop; Michael G. Gilman; Charles J. Speciale

[57] ABSTRACT

In the manufacture of draw tape bags hems are formed in the opposing panels of the moving web of folded thermoplastic film by utilizing tucker bars, that tuck the hem for the draw tape bags, equipped with a series of rubber wheels that pull the film diagonally so that it is tight against the edge of the folding boards.

5 Claims, 4 Drawing Sheets

APPARATUS FOR FORMING A HEM IN A MOVING WEB OF FILM

This is a continuation of copending application Ser. No. 938,893, filed on Dec. 8, 1986, now abandoned.

BACKGROUND OF THE INVENTION

This invention relates to apparatus for forming a hem in a moving web of film and more particularly to an improved hem folder tucker bar for use in making hems in the manufacture of draw tape plastic bags.

Bags made of thin polyethylene material have been used in various sizes. Smaller bags are used in the packaging of sandwiches and the like; larger bags are used as shopping bags; and even larger bags are used for containing trash.

A particularly advantageous closure for such a bag includes a draw tape constructed from the same polyethylene material. U.S. Pat. No. 3,029,853—Piazzi, and British Pat. No. 1,125,363—Jortikka are examples of draw tape bags. Such closures have been successfully employed on these bags.

Draw tape closures for large trash bags, and the manufacture of these draw tape trash bags, are described in the related applications identified below.

Forming the hem, into which the tape is inserted, is shown, for example, in U.S. Pats. Nos. 2,897,729—Ashton et al, 3,058,402—Krugler, 3,058,403—Krugler and in pending applications of applicant's assignee including "Method and Apparatus for Forming Hems in Superposed Pliable Panels", Boyd et al, Ser. No. 652,255, filed Sept. 20, 1984 now U.S. Pat. No. 4,717,008 and "HEM FOLDER WITH INTEGRAL TAPE INSERTER FOR MAKING DRAW TAPE BAGS," Herrington, Ser. No. 871,238 filed June 6, 1986, now U.S. Pat. No. 4714455. Apparatus for sealing a hem in a moving web of film is disclosed in copending patent applications of applicant's assignee including "Apparatus for Sealing a Hem in a Moving Web of Film Using Angularly Oriented Hot Wheels", Catchman and Herrington Ser. No. 904,449 filed Sept. 8, 1986, now U.S. Pat. No. 4,717,373; Apparatus for Sealing a Hem in a Moving Web of Film, Herrington, Ser. No. 904,441 filed Sept. 8, 1986, now U.S. Pat. No. 4,721,502 and Apparatus for Producing a Machine-Direction Heat Seal, Herrington, Ser. No. 904,444 filed Sept. 8, 1986, now U.S. Pat. No. 4,721,501. The foregoing applications are incorporated herein by reference thereto.

In forming hems in a moving web of film in the manufacture of plastic bags as disclosed in the above-identified patent applications the web of film is pulled over folding boards and a tucker bar is used to tuck an edge of the moving web onto the other side of each folding board so as to produce a hem. It has been found that variations in film gauge or tension sometimes cause the hem film to be loosely drawn around the edge of the board so that the hem is not well defined and bag length and hem width are not precise.

It is an object of the present invention to fold a hem in a moving web of film and to pull the film diagonally so that it is tight against the edge of the folding board prior to heat sealing the hem.

It is another object of the present invention to form hems in the opposing panels of the moving web of folded thermoplastic film in the manufacture of draw tape bags by utilizing tucker bars, that tuck the hem for the draw tape bags, equipped with a series of rubber wheels that pull the film diagonally so that it is tight against the edge of the folding board.

SUMMARY OF THE INVENTION

In forming a hem in a moving web of film, the film is passed over one side of a folding surface having a width, where the web impinges on the surface wider than the final web width after hem forming, the surface decreasing in width to the final web width, and tucking an edge of the web onto the other side of the surface to produce a hem in the web by pulling the film diagonally so that it is tight against the edge of the folding surface the web is at the final web width upon leaving the surface.

The apparatus for forming a hem in a moving web of film comprises a folding surface having a width, where the web impinges on the surface, wider than the final web width after hem forming, the surface decreasing in width to the final web width, the web passing on one side of the surface, and means for tucking an edge of the web onto the other side of the surface to produce a hem in the web, the last named means comprising a plurality of friction wheels, such as rubber wheels, arranged to pull the film diagonally so that it is tight against the edge of the folding surface whereby the web is at the final web width upon leaving the surface.

The foregoing and other objects, features and advantages of the invention will be better understood from the following, more detailed description and appended claims.

SHORT DESCRIPTION OF THE DRAWINGS

DESCRIPTION OF A SPECIFIC EMBODIMENT

Figure 1:
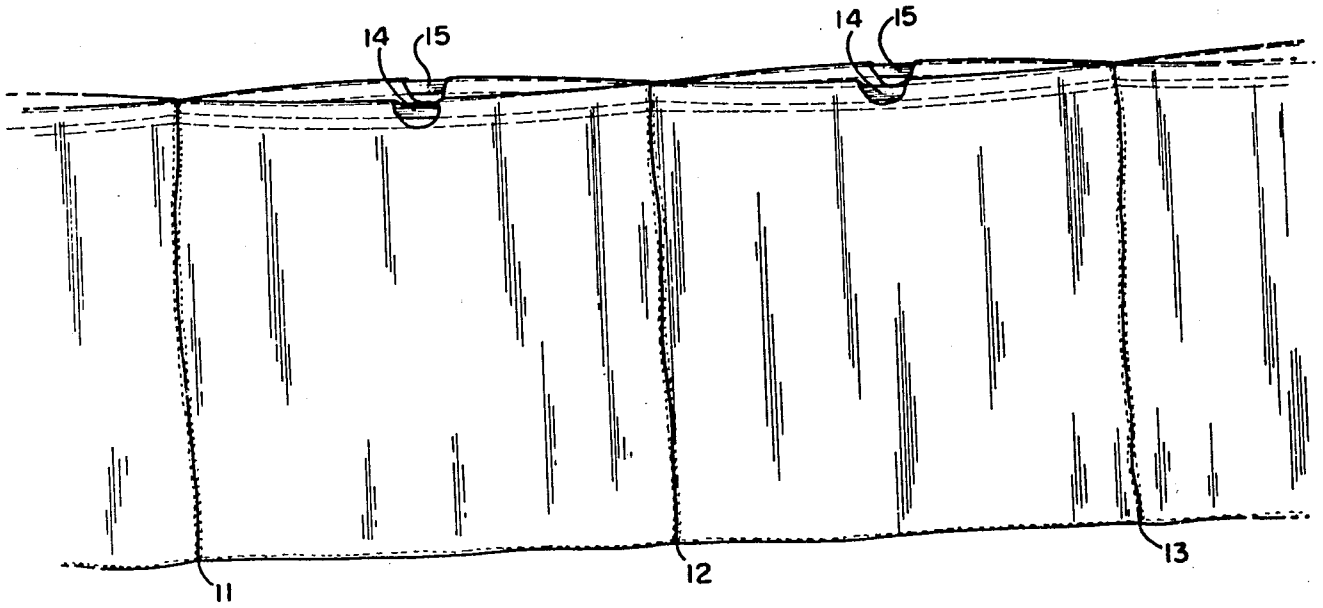
FIG. 1 shows a series of draw tape bags made in accordance with the present invention.

FIG. 1 shows a series of draw tape bags formed from an extruded tube of polyethylene. The tube is slit along one side to form open tops in the bags for reception of trash and like. The tube of film is folded along the other side to form the bag bottom. The sides of the panels are heat sealed and cut from the tube in a perpendicular direction at 11, 12 and 13 to form individual bags.

Hemmed portions of each opposing panel are folded over adjacent the top. Draw tapes 14 and 15 are inserted into hems and are secured by the heat seal at the sides of the panels. Tape holes are cut in each panel exposing the draw tapes so that they can be grasped. The distance from the bottom of the bags to the top is referred to as "web width" or "bag length" herein.

Figure 2:
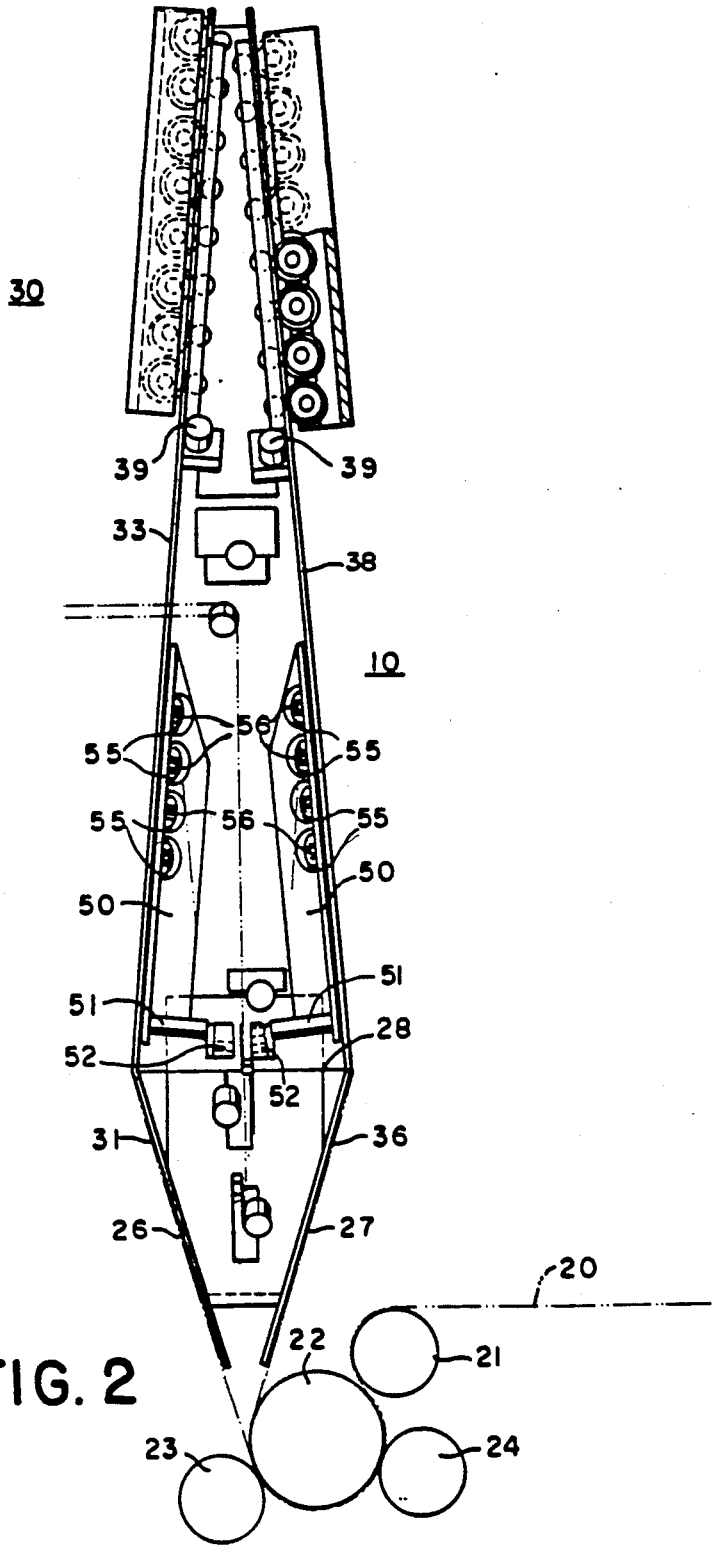
FIG. 2 is a front elevation view of the machine embodying the hem forming apparatus of the present invention.
Figure 3:
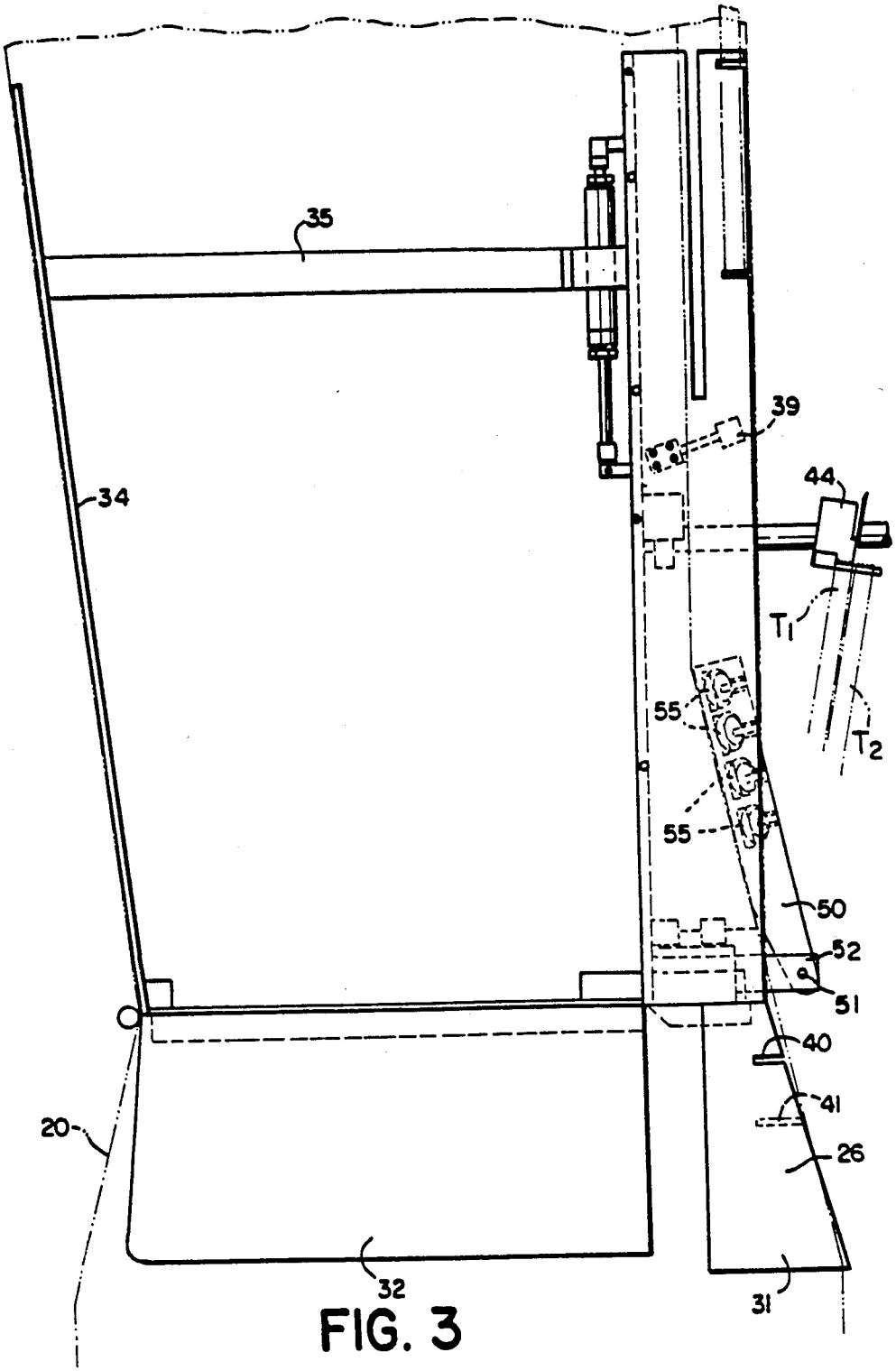
FIG. 3 is a side elevation view of the machine of FIG. 2.

FIGS. 2 and 3 illustrate a machine 10 embodying the apparatus of the present invention for forming a hem in a moving web of film. A moving web of film 20 is formed from an extruded tube of polyethylene which has been slit on the side facing the viewer in FIG. 2 and folded on the other side to form two opposing layers of film. This moving web 20 enters the machine 10 through rollers 21, 22, 23 and 24 with the roller 24 having punch elements which form the holes for grasping the tape.

The hem forming apparatus illustrated in FIGS. 2 and 3 includes structure having two folding surfaces 26 and 27 which are flat and converge outwardly from the feed rolls 21–24 to a point of maximum separation at 28 and then converge inwardly to a point of close separation adjacent the hem sealing apparatus. The folding surface 26, FIG. 3, is made up of a lower hem plate 31, a lead-in plate 32, an upper hem plate 33 and the edge of a bottom plate 34 which is separated from the upper hem plate 33 by a spacer 35 and the lead-in plate 32. The lead-in plate 32 and the lower hem plate 31 are both in the same plane and diverge outwardly to the point 28 as shown in FIG. 2. The other surface 27, FIG. 2, includes a lower hem plate 36, a lead plate (not shown) similar to plate 32 and in the same plane as plate 36, an upper hem plate 38 and the opposite edge of the bottom plate 34. The bottom plate 34 is triangularly shaped having its base along the line 28 in FIG. 2 and its apex adjacent the upper end of of the hem plates 33 and 38.

Figure 4:
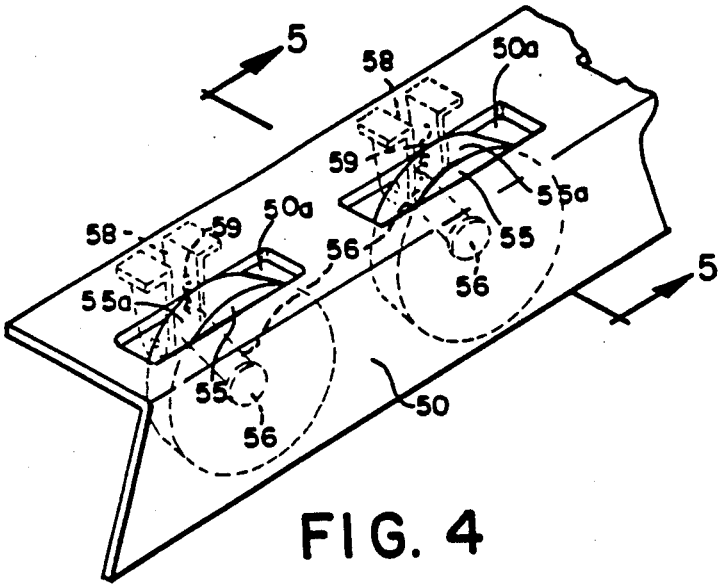
FIG. 4 is a perspective view of the tucker bar with rubber wheels embodying the present invention.

When the web impinges on the surfaces 26 and 27, FIGS. 2 and 3, the folded edge of the web 20 which is to form the bottom of the bags will pass over the bottom plate 34 as shown in FIG. 3. A layer of the film passes over the outside of each of the surfaces 26 and 27 and the split edges of the film are tucked onto the other side of each surface by tucker bars 50 to produce a hem in each opposing layer of film. The apparatus for tucking the film is more fully described and illustrated in connection with FIGS. 4 and 5 as later to be described. Rollers 39, FIGS. 2 and 3, supported in relation to the hem plate 33 and 38 maintain the moving web of film tightly around the respective surfaces 26 and 27 and against the opposite sides thereof to avoid formation of wrinkles in the film during the heat sealing. Slots 40 and 41, FIG. 3, in the lower hem plates 31 and 36, receive the tapes T1 and T2 which are inserted into the hems of the moving web of film. A tape splitter 44 produces the two tapes T1 and T2 from a single tape. The hem sealing apparatus 30, FIG. 2, which is supported from the frame of the machine, seals the folded over hem portion of the side panel of the bag so that the draw tape is secured in the hem of the bag. After the heat sealed hems leave the hem sealing apparatus 30, they are preferably cooled so as to prevent stretching of the film as it passes through nip rolls and proceeds to the further processing steps of side sealing and cutting into individual bags. The present invention is concerned with the improved method and apparatus for forming the hem in a moving web of film preparatory to heat sealing the hems in the bags.

Figure 5:
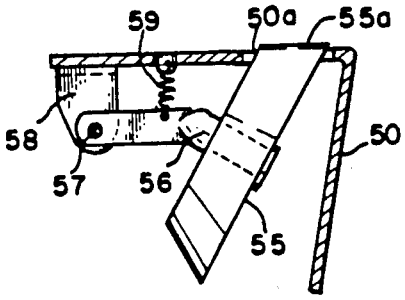
FIG. 5 is a sectional view taken alone the lines 5—5 in FIG. 4.

As may be seen in FIG. 2 the machine 10 is provided with a pair of tucker bars 50, one associated with each of the upper hem plates 33 and 38 of the folding surfaces 26 and 27 respectively. The tucker bars 50 are angle shaped members as may be seen in FIGS. 4 and 5 and are supported on pivots 51 which in turn are mounted on stationary brackets 52 secured to the machine. Each of the tucker bars 50 is provided with a plurality of openings 50*a* through which extend a corresponding plurality of wheels 55. The wheels 55 are provided with a beveled edge 55*a* which is a friction surface and is parallel to and extends slightly above the openings 50*a* in the tucker bar 50, FIG. 5. The wheels 55 preferably are rubber or equivalent material and are rotatably mounted on shafts 56 which in turn are pivotally mounted at 57 to brackets 58 secured to one side of the tucker bars 50, FIG. 5. The wheels 55 are spring biased in an upward direction as shown in FIG. 5 by means of the tension springs 59 which are connected to the shafts 56 and one side of the tucker bar 50.

As previously pointed out, a layer of the film 20 passes over the outside of each of the surfaces 26 and 27 and the split edges of the film are tucked onto the other side of each surface by the tucker bars 50 to produce a hem in each opposing layer of film, FIGS. 2 and 3. The beveled surfaces 55*a* of the rubber wheels 55 engage the side of the split edges of the film at the hem area, FIG. 3 and pull the film diagonally so that it is tight against the edge of the folding boards or upper hem plates 33 and 38. The wheels 55 supplement the canted wheels or rollers 39 so that the hem is drawn tightly to its proper position around the edge of the folding boards thus assuring that the hem is well defined and the bag length and hem width are precise.

While the present invention has been described in connection with a bag making machine of the type disclosed in the present application, it is to be understood that the hem forming apparatus embodying the present invention may be utilized in other bag making machines and in other applications for sealing a hem in a moving web of film.

What is claimed is:

1. In a machine for making draw tape bags from a moving web of folded thermoplastic film having two folded opposing faces, each having a split edge to be folded into a hem to receive a draw tape, the improved apparatus for forming a pair of hems in the moving web of film comprising:

a pair of spaced folding surfaces on which the respective folded faces of the web impinge, said surfaces being in spaced planes and each having a final width corresponding to the final bag length, one folded face of the web passing over one side of each of said surfaces; and means for tucking each split edge of the web between said spaced surfaces onto the other side of each surface to produce a hem in each split edge of the web, said last named means comprising a pair of tucker bars positioned between said folding surfaces for engaging the film and a plurality of friction wheels rotatably mounted in tandem on each of said tucker bars for engaging the film and arranged to pull the film diagonally so it is tight against the edges of said folding surfaces whereby the web with the pair of hems therein is at the final bag length prior to sealing the hems.

2. Apparatus for forming a pair of hems according to claim 1 wherein said plurality of wheels are rubber wheels, and each said tucker bar has a plurality of openings therein through which said wheels extend.

3. Apparatus us for forming a pair of hems according to claim 1 wherein said plurality of wheels are rubber wheels, the rims of said wheels being parallel to the folding surfaces.

4. Apparatus for forming a pair of hems according to claim 1 including spring means mounted on said tucker bars for biasing said wheels against said web for maintaining said web against said folding surfaces during movement of said web through said hem forming apparatus.

5. A method for forming a pair of hems in a moving web of folded thermoplastic film having two folded opposing faces each having a split edge to be formed into a hem to receive a draw tape in the manufacture of draw tape bags comprising:

passing the opposing folded faces of the web of film over a pair of spaced folding surfaces on which the respective folded faces of the web impinge , the surfaces being in spaced planes and each having a final width corresponding to the final bag length, one folded face of the web passing over one side of each of the surfaces; and tucking each split edge of the web between the spaced surfaces onto the other side of each surface to produce a hem in each split edge of the web and concurrently applying a force to the film as the film is being tucked betweeen the surfaces in the direction of each surface and pulling the film diagonally so it is tight against the edges of the folding surfaces whereby the web with the pair of hems therein is at the final bag length prior to heat sealing the hems.

* * * * *